US006030543A

United States Patent [19]

Placek et al.

[11] Patent Number: 6,030,543

[45] Date of Patent: Feb. 29, 2000

[54] AIRCRAFT HYDRAULIC FLUID BASESTOCKS

[75] Inventors: Douglas G. Placek, Fairless Hills, Pa.; Sundeep G. Shankwalkar, East Brunswick, N.J.

[73] Assignee: Great Lakes Chemical Corporation, West Lafayette, Ind.

[21] Appl. No.: 08/026,039

[22] Filed: Mar. 4, 1993

[51] Int. Cl.[7] ..... C09K 5/00; C10M 103/00

[52] U.S. Cl. ..... 252/78.5; 252/77; 252/78.3; 252/49.8

[58] Field of Search ..... 252/78.5, 565, 252/49.8, 78.3, 77

[56] References Cited

U.S. PATENT DOCUMENTS

| | | | |
|---|---|---|---|
| 2,750,342 | 6/1956 | Mikesa et al. | 252/46.6 |
| 2,933,449 | 4/1960 | Moreton | 252/49.9 |
| 3,576,923 | 4/1971 | Randell et al. | 260/966 |
| 3,592,772 | 7/1971 | Godfrey et al. | 252/78 |
| 3,679,587 | 7/1972 | Smith | 252/75 |
| 3,769,221 | 10/1973 | Burrous | 252/78 |
| 3,849,324 | 11/1974 | Sheratte | 252/78 |
| 3,935,116 | 1/1976 | Sheratte | 252/78 |
| 4,001,129 | 1/1977 | Sheratte | 252/78.5 |
| 4,116,877 | 9/1978 | Outten et al. | 252/72 |

FOREIGN PATENT DOCUMENTS

| | | |
|---|---|---|
| 0135932 | 9/1984 | European Pat. Off. . |
| 9219703 | 4/1992 | WIPO . |

OTHER PUBLICATIONS

Kirk–Othmer, Encyclopedia of Chemical Technology, Third Edition., vol. 12, pp. 712–733, Wiley & Sons, 1980.

*Primary Examiner*—Necholus Ogden
*Attorney, Agent, or Firm*—Woodard, Emhardt, Naughton, Moriarty & McNett Patent and Trademark Attorneys

[57] ABSTRACT

The present invention is a composition particularly suitable for use as a base for aircraft non-flammable hydraulic fluids with reduced wear according to the ASTM four ball test. The compositions comprise trialkyoxyalkyl phosphate esters optionally formulated with alkyl phosphite esters and alkyl and alkaryl phosphate esters.

14 Claims, No Drawings

AIRCRAFT HYDRAULIC FLUID BASESTOCKS

This invention relates to functional fluid compositions having good fire resistance and desirable viscosity characteristics both at high and low temperatures, and is especially directed to functional fluid compositions having the above-noted properties, particularly improved fire resistance and reduced deleterious effect on the swelling of hydraulic seals.

Many different types of materials are employed as functional fluids, and functional fluids are utilized in a wide variety of applications. Thus, such fluids have been utilized as electronic coolants, diffusion pump fluids, lubricants, damping fluid, power transmission and hydraulic fluids, heat transfer fluids and heat pump fluids. A particularly importafnt application of such functional fluids has been their utilization as hydraulic fluids and lubricants in aircraft, requiring successful operation of such fluids over a wide temperature range.

Functional and hydraulic fluids employed in many industrial applications and particularly hydraulic fluids for aircraft must meet a number of important requirements. Thus, such hydraulic fluids, particularly for aircraft use, should be operable over a wide temperature range, should have good stability at relatively high temperatures and preferably have good lubricating characteristics (low wear). In addition to having the usual combination of properties making it a good lubricant or hydraulic fluid, such fluid should also have relatively low viscosity at extremely low temperatures and an adequately high viscosity at relatively high temperatures, and must have adequate stability at high operating temperatures. Further, it is of importance that such fluids be compatible with materials used in aircraft hydraulic systems including both metals and non-metals such as elastomeric or rubber seals of the system. It is also important for aircraft hydraulic fluids and lubricants to have as high a fire resistance as possible to prevent ignition if such fluids are accidentally or as result of damage to the hydraulic system, sprayed onto or come into contact with surfaces of materials of high temperature. Another important property for a hydraulic fluid in aircraft is a low density to increase payload, desirably a specific gravity of less than 1.03, preferably less than 1.00, and most preferably a specific gravity of less than 0.98.

Hydraulic fluids in commercial jet aircraft are exposed to temperatures ranging from below −40° C. (−40° F.) to over 93° C. (200° F.). Within these temperature extremes, it is necessary for the fluid to maintain a reasonably low viscosity when cold, and yet not become too thin when hot. As a general rule, this means that the fluid preferably should have a viscosity of less than 4,200 cs. (centistokes) at −54° C. (−65° F.), and maintain a viscosity preferably above 3.0 at 99° C. (210° F.).

According to U.S. Pat. No. 3,935,116, phosphate esters are among the most commonly employed base stocks, of which tributyl phosphate and dibutyl phenyl phosphate are widely used components, but both of the latter phosphates are too thin at high temperatures, and their use alone would result in rapid wear of moving parts. Other phosphate esters, such as tricresyl phosphate, for example, which provide the requisite high temperature viscosity become too thick to be useful at low temperatures. Even mixtures of various phosphate esters such as those noted above do not provide the required viscosity characteristics at both low and high temperatures. Accordingly, it has been the practice to achieve the required wide viscosity range required for aircraft hydraulic fluids by adding to a base stock, such as phosphate ester or mixtures thereof, a small proportion, e.g., up to 10%, of a polymeric material, such as polyalkyl acrylates or methacrylates, whose solubility characteristics in the base stock are chosen so that the polymeric material thickens the fluid more at high temperatures than at low temperatures, and thus functions as a viscosity index (VI) improver.

U.S. Pat. No. 2,750,342 to Mikeska et al. teaches that triaryl phosphate esters of ether alcohols are very desirable additives to improve the pour point and viscosity index of mineral oil lubricants. Although the trialkyl phosphate decreases the flammability of the formulated hydraulic fluid, it does not provide the desired fire resistance to the mineral oil based lubricant.

U.S. Pat. No. 2,933,449 to Moreton teaches that it is necessary for a flame retardant base fluid for hydraulic applications to contain three essential ingredients: a viscosity index enhancer, an ester of a phosphorus acid and a heavily halogenated hydrocarbon. However, the presence of the halogenated hydrocarbon is very objectionable in that it increases the specific gravity of the hydraulic fluid, thereby reducing the payload when used in the hydraulic system of an aircraft.

U.S. Pat. No. 3,592,772 to Godfrey et al. discloses that hydraulic fluids containing substantial amounts of triesters of orthophosphoric acid cause cavitation which adversely affects both the mechanical parts of the hydraulic system and the hydraulic fluid itself. The patent teaches that the addition of ammonia to the fluid reduces the cavitation and its resulting damage to the equipment and the fluid.

U.S. Pat. No. 3,679,587 to Smith teaches that the cavitation problem of phosphate esters may be overcome by the addition of a perfluorinated organic compound, preferably alkali metal salts of perfluorinated sulfonic acids. The patent further teaches that the phosphate esters which require this additive include the tri alkoxy alkyl phosphates.

U.S. Pat. No. 3,769,221 to Burrous discloses that hydraulic systems contain neoprene, Buna-N, vinylidene fluoride-hexafluoropropylene, butyl, ethylene-propylene, silicone, fluorosilane and polynitrile elastomers as seals and packing, and that the ordinary phosphate esters generally cause excessive swelling of these elastomers. The patent teaches specific flame resistant hydraulic base fluids compatible with conventional elastomers formulated from a mixture of an oxyalkyl and/or p-alkoxyphenyl ester of phosphoric acid, and an alkyl, aryl alkaryl or aralkyl phosphate ester, optionally with conventional functional fluid additives; however, the patent also discloses that the effect of individual alkoxyalkyl esters is unpredictable, even on ethylene-propylene elastomers.

U.S. Pat. No. 4,116,877 to Outten et al. teaches that an organophosphite ester and a phenol combined in a range of 1:4 to 4:1 parts by weight enhances the compatibility of a mineral oil based hydraulic fluid to typical elastomers (Buna-N, polyacrylic, SBR, and polyacrylonitrile) employed in automotive automatic transmission and power steering fluids. However, the patent discloses that each of the components is inferior to the combination when employed in a mineral oil base functional fluid, either alone, or outside the claimed 1:4/4:1 use range.

It is well known according to Kirk-Othmer, *Encyclopedia of Chemical Technology*, Third Edition, Vol. 12, page 719, that while phosphate esters have better fire resistance than mineral oils, their decomposition products can be corrosive. Generally, they have poor viscosity-temperature characteristics, although their pour points and volatility are low. Phosphate esters have considerable effect on paints and finishes and may cause swelling of many seal materials. Their hydrolytic stability is fair. They have specific gravities greater than one which implies that water contamination tends to float rather than settle to the bottom, resulting in high pumping losses.

It is desirable to provide a functional fluid which is particularly useful as an aircraft hydraulic fluid and which has excellent wear and viscosity characteristics over a wide temperature range, low density and which has the other improved properties necessary for a good hydraulic fluid, including good fire resistance and freedom from corrosivity. The most important properties are reduced wear on metallic parts (e.g. a wear scar of less than 1 mm determined by ASTM D-2266), and a low specific gravity.

The present invention provides an improved fire resistant hydraulic base fluid composition having a specific gravity of less than 1.03, and a four-ball wear scar of less than 0.9 mm, the improvement comprising 1 to 12 parts by weight of a trialkoxyalkyl phosphate ester, each alkoxyalkyl moiety containing about 6 to 10 carbon atoms, and 1 part by weight of an ester or a mixture of esters selected from the group consisting of a trialkyl ester of phosphoric acid and C4–C8 alkyl alcohols, a triaryl phosphate ester wherein the aryl groups are partially C3 to C4 alkylated phenols, and-a trialkyl phosphite ester having a pour point of less than −50° C., each alkyl group of the trialkyl phosphite ester containing from 8 to 12 carbon atoms.

More particularly, the present invention provides an improved fire resistant hydraulic base fluid composition position having a specific gravity of less than 1.00, and a four-ball wear scar of less than 0.8 mm, the improvement comprising about one part by weight of a trialkyl phosphite ester having a pour point of less than −50° C., 2 to 4 parts by weight of a trialkoxyalkyl phosphate ester, wherein each alkoxyalkyl moiety contains about 6 to 10 carbon atoms, and an ester or a mixture of esters selected from the group consisting of a trialkyl ester of phosphoric acid and C4–C8 alkyl alcohols, a triaryl phosphate ester wherein the aryl groups are partially C3 to C4 alkylated phenols, and each alkyl group of the trialkyl phosphate ester having from 8 to 12 carbon atoms, the ester or mixture of esters being present in an amount equal to about 0.4 to 4 parts by weight per part by weight of the phosphite ester.

The functional fluids produced according to the invention can be blended as noted above to have excellent fire resistance and at the same time, to have suitably low viscosity at temperatures below −40° C., and down to −54° C., and suitably high viscosity at high temperatures of 100° C. and above. Also the functional fluid compositions and blends of the present invention have improved thermal and hydrolytic stability compared with the phosphate ester based fluids currently in use, contributing to a long useful life for the fluid. In addition, the functional fluids according to the present invention can be formulated to produce wear scars of less than 0.9 mm and preferably less than 0.8 mm and specific gravities of the order of less than 1.03, desirably less than 1.02 or less, and preferably less than 0.98, an important property for aircraft hydraulic fluids. The above advantages can be achieved while at the same time improving the characteristics of phosphate ester-type hydraulic fluids currently in use. The functional fluids formulated according to the invention not only have freedom from corrosivity, but unexpectedly have reduced wear compared with their individual components.

In addition to their valuable application as hydraulic fluids for aircraft hydraulic systems, the fluids, according to the invention have important applications as hydraulic or functional fluids in industrial and marine fields, particularly in industrial turbine systems.

Suitable C6 to C10 trialkyloxyalkyl phosphate esters include triesters containing butoxyethyl, phenoxyethyl, octoxyethyl, butoxybutyl moieties, either as a tris ester (e.g. trisbutoxyethyl phosphate) or mixed esters (e.g. dibutoxyethyl octoxyethyl phosphate). For economic reasons a trisalkoxyalkyl phosphate is more desirable, preferably trisbutoxyethyl phosphate.

The criteria for selecting trialkylphosphite ester should be selected on the basis of a low pour point (less than −50° C.) and a suitable specific gravity. Tris isooctyl phosphite is preferred, but any tris phosphite ester or mixed phosphite ester is suitable.

Any C4 to C8 phosphate ester may be employed in the invention. For example, tributyl phosphate (TBP) and tri isooctal phosphate (TOF) are employed in the examples. The specific triphosphate ester or combination of esters can easily be selected by one skilled in the art to adjust the density, viscosity etc. of the formulated fluid. Mixed esters, such as dibutyl octyl phosphate or the like may be employed rather than a mixture of two or more trialkyl phosphates.

A trialkyl phosphate is useful to increase the specific gravity of the formulation, but it is desirable that the specific trialkyl phosphate be a liquid at low temperatures. Consequently, a mixed ester containing at least one partially alkylated with a C3 to C4 alkyl group is very desirable, for example, 4-isopropylphenyl diphenyl phosphate or 3-butylphenyl diphenyl phosphate. Even more desirable is a triaryl phosphate produced by partially alkylating phenol with butylene or propylene to form a mixed phenol which is then reacted with phosphorus oxychloride as taught in U.S. Pat. No. 3,576,923.

Any mixed triaryl phosphate (TAP) esters may be used such as cresyl diphenyl phosphate, tricresyl phosphate, mixed xylyl cresyl phosphates, lower alkylphenyl/phenyl phosphates, such as mixed isopropylphenyl/phenyl phosphates, t-butylphenyl/phenyl phosphates. These esters are used extensively as plasticizers, functional fluids, gasoline additives, flame-retardant additives and the like. These products are conventionally prepared by the phosphorylation of a suitable phenolic feedstock either the so-called natural cresols which are coal tar phenol fractions or synthetic feedstocks produced by alkylation of phenols as described, for example, in U.S. Pat. No. 3,576,923 issued Apr. 27, 1971 to Randell et al. Desirably the synthetic esters are employed. The preferable triarylphosphate composition is available under the tradename Durad B80 from FMC Corporation.

It will be understood that other additives such as corrosion inhibitors, oxidation inhibitors, stabilizers, metal deactivators, and the like, such as epoxides, dialkyl sulfides, benzothiazole, phenyl alpha-naphthylamine and phenolic oxidation inhibitors, well known as functional fluid additives in the art, can also be incorporated in the functional fluid composition of the invention, in relatively small amounts, if desired.

Commonly used additives according to Kirk-Othmer include pour-point depressants such as alkylaromatic polymers and polymethacrylates, viscosity index improvers (VI improvers), high molecular weight polymers that increase the relative viscosity of an oil at high temperatures more than they do at low temperatures. The most common VI improvers are methacrylate polymers and copolymers, acrylate polymers, olefin polymers (qv) and copolymers, and styrene-butadiene copolymers.

Other additives are defoamers, such as silicone polymers, the most widely used defoamers. Organic polymers are sometimes used as defoamers although much higher concentrations are required.

Oxidation inhibitors are also employed. Two general types of oxidation inhibitors are those that react with the initiators, peroxy radicals, and hydroperoxides to form inactive compounds, and those that decompose these materials to form less active compounds. Examples are hindered (alkylated) phenols, e.g. 6-di(tert-butyl)-4-methylphenol [2,6-di(tert-butyl)-p-cresol, DBPC], and aromatic amines, e.g. N-phenyl-α-naphthylamine. These are used in turbine, circulation, and hydraulic oils that are intended for extended service at moderate temperatures.

Corrosion and rust inhibitors, typically amine succinates and alkaline earth sulfonates are employed for corrosion inhibition. Optionally, phosphorus-containing materials, such as zinc dithiophosphate are employed as rust inhibitors.

Wear and friction reducing compounds commonly employed are long chain molecules which form a film on metal surfaces.

ASTM 2266—FOUR BALL TEST

The four ball test method employed in the examples involves rotating a steel ball against three stationary lubricated steel balls at 1200 rpm and 75° C. with a 40 kg load for 60 minutes. The diameter of the wear scar after completion of the test is then measured to determine the effectiveness of the lubricant.

EXAMPLES 1 TO 4

The following formulations of phosphorus acid esters were evaluated by the Four Ball Wear test:

All percents are by weight.

EXAMPLES

A. tributyl phosphate (TBP)

B. trisooctyl phosphite (TIOP)

C. tributoxyethyl phosphate (FMC KP-140)

D. Commercial phosphate aircraft hydraulic fluid containing a methylacrylate polymer viscosity improver (VI)

1. Phosphate Ester Blend
   6% triaryl phosphate (FMC DURAD 150)
   89% tributoxyethyl phosphate (FMC KP-140)
   5% methacrylate polymer (VI)
2. Phosphate/Phosphite
   7% triaryl phosphate (FMC Durad 150)
   40% tributoxyethyl phosphate (FMC KP-140)
   24% tributyl phosphate (TBP)
   17% triisooctyl phosphite (TIOP)
   5% trioctyl phosphate (TOF)
   7% methacrylate polymer (VI)
3. Phosphate/Phosphite
   7% triaryl phosphate (FMC Durad 150)
   48% tributoxyethyl phosphate (FMC Durad 150)
   23% tributyl phosphate (TBP)
   12% triisooctyl phosphite (TIOP)
   3% trioctyl phosphate (TOF)
   7% methacrylate polymer (VI)
4. Phosphate/Phosphite
   56% tributoxyethyl phosphate (FMC KP-140)
   12% tributyl phosphate (TBP)
   25% triisooctyl phosphite (TIOP)
   7% methacrylate polymer (VI)

Table I indicates that the phosphate blend formulations containing alkoxyalkyl phosphates in general have improved wear characteristics than their individual constituents. Further, it shows that extremely improved wear resistance is demonstrated by formulations containing a trialkylphosphate ester, and that in compositions having a specific gravity of less than 1.000, the increase of the phosphite not only decreases the wear, but has the added advantage of reducing the specific gravity.

EXAMPLES 5 TO 19

Table II shows the wide range of formulations which can be prepared. A series of formulations was prepared employing tributoxyethyl phosphate, commercially available from FMC Corporation under the trademark KP-140, trialkylphosphate (both tributyl phosphate, TBP, and triisooctylphosphate, TOF), mixed triaryl phosphate (FMC Corporation's Durad B-80) and commercial triisooctyl phosphite. The compositions and properties are presented as Table II. Examples 1 to 4 are included.

Most of the examples also contain a polyacrylate viscosity improver (VI) which is conveniently included in the finished formulations. The Table demonstrates to one skilled in the art the wide range of viscosity and specific gravity which can be obtained.

TABLE I

SPECIFIC GRAVITY AND WEAR OF FLUIDS

| Example No. | Composition | % TIOP | Specific Gravity | Wear Four Ball Scar (mm) |
|---|---|---|---|---|
| A | tributylphosphate | 0 | 0.980 | 0.83 |
| B | trioctylphosphite | 100 | 0.880 | 0.96 |
| C | tributoxyethyl phosphate | 0 | 1.020 | 0.87 |
| D | commercial fluid | 0 | .997 | 0.96 |
| 1 | Phosphate ester blend | 0 | 1.029 | 0.71 |
| 2 | Phosphate/phosphite | 17 | 0.993 | 0.71 |
| 3 | Phosphate/phosphite | 12 | 1.000 | 0.72 |
| 4 | Phosphate/phosphite | 25 | 0.981 | 0.53 |

TABLE II

EFFECT OF FORMULATION ON VISCOSITY AND SPECIFIC GRAVITY

| | Parts By Weight | | | | | | Viscosity cSt. | | | |
|---|---|---|---|---|---|---|---|---|---|---|
| Example No. | KP-140 | DURAD B80 | TBP | TOF | TIOP | Parts VI | 38° C. 100° F. | 99° C. 210° F. | −54° C. −65° F. | S.G. |
| 1 | 89 | 6 | 0 | 0 | 0 | 5 | 10.56 | 3.06 | 3778 | 1.029 |
| 2 | 40 | 7 | 24 | 5 | 27 | 7 | 9.98 | 3.11 | 1831 | 0.993 |
| 3 | 48 | 7 | 23 | 3 | 12 | 7 | 9.64 | 3.05 | 1759 | 1.000 |

TABLE II-continued

EFFECT OF FORMULATION ON VISCOSITY AND SPECIFIC GRAVITY

| Example No. | Parts By Weight KP-140 | DURAD B80 | TBP | TOF | TIOP | Parts VI | Viscosity cSt. 38° C. 100° F. | 99° C. 210° F. | −54° C. −65° F. | S.G. |
|---|---|---|---|---|---|---|---|---|---|---|
| 4 | 56 | 0 | 12 | 0 | 25 | 7 | 9.54 | 3.00 | 1666 | 0.981 |
| 5 | 48 | 7 | 23 | 0 | 15 | 7 | 9.92 | 3.01 | 1721 | 0.999 |
| 6 | 47 | 7 | 22 | 5 | 12 | 7 | 9.96 | 3.08 | 1951 | 0.999 |
| 7 | 58 | 10 | 20 | 5 | 0 | 7 | 10.65 | 3.23 | 2461 | NA |
| 8 | 60 | 3 | 15 | 0 | 15 | 7 | 9.94 | 3.06 | 1933 | 0.998 |
| 9 | 85 | 8 | 2 | 0 | 0 | 5 | 10.56 | 3.06 | 4028 | 1.032 |
| 10 | 79 | 6 | 0 | 0 | 10 | 5 | 10.39 | 3.04 | 3524 | 1.015 |
| 11 | 80 | 20 | 0 | 0 | 0 | 0 | 8.2 | 2.26 | ~1500 | ~1.12 |
| 12 | 48 | 5 | 18 | 0 | 22 | 7 | 9.87 | 3.04 | 2000 | 0.992 |
| 13 | 60 | 40 | 0 | 0 | 0 | 0 | 10.22 | 2.55 | ~3500 | ~1.14 |
| 14 | 57 | 7 | 24 | 5 | 0 | 7 | 10.02 | 3.10 | 1853 | 1.019 |
| 15 | 57 | 7 | 24 | 0 | 5 | 7 | 9.77 | 3.04 | 1774 | 1.015 |
| 16 | 59 | 9 | 25 | 0 | 0 | 7 | 10.0 | 3.07 | 1998 | 1.020 |
| 17 | 47 | 7 | 22 | 5 | 12 | 7 | 9.96 | 3.08 | 1951 | 0.999 |
| 18 | 45 | 45* | 0 | 0 | 0 | 10 | 30 | 6.4 | 14000** | 1.09 |
| 19 | 28 | 10* | 40 | 0 | 0 | 22 | 28 | 8 | 18000** | 1.10 |

KP-140 — FMC Corporation Trademark — a C6 alkoxyalkyl phosphate
Durad B80 — FMC Corporation Trademark — a mixed butylated phenyl phosphate
*Durad 150 — FMC Corporation Trademark — a mixed propylated phenyl phosphate
TBP — tributyl phosphate — a C4 trialkylphosphate
TOF — trioctyl phosphate — a C8 trialkylphosphate
TIOP — triisooctyl phosphite
VI — a polyacrylate viscosity improver
NA — not available
Viscosity cSt — viscosity in centistokes
**Approximate

We claim:

1. An improved fire resistant hydraulic base fluid composition having a specific gravity of less than 1.03, and a four-ball wear scar of less than 0.9 mm, the improvement consisting essentially of 1 to 12 parts by weight of a trialkoxyalkyl phosphate ester, each alkoxyalkyl moiety containing about 6 to 10 carbon atoms, and 1 part by weight of an ester or a mixture of esters selected from the group consisting of a trialkyl ester of phosphoric acid and C4–C8 alkyl alcohols, a triaryl phosphate ester wherein the aryl groups are partially C3 to C4 alkylated phenols, and a trialkyl phosphite ester having a pour point of less than −50° C., each alkyl group of the trialkyl phosphite ester containing from 8 to 12 carbon atoms.

2. The composition of claim 1 wherein the trialkoxyalkyl phosphate ester is tributoxyalkyl phosphate.

3. The composition of claim 1 wherein the trialkyl phosphite ester is triisooctyl phosphite.

4. The composition of claim 2 wherein the trialkyl phosphite ester is triisooctyl phosphite.

5. An improved hydraulic fluid composition comprising the composition of claim 1 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

6. An improved hydraulic fluid composition comprising the composition of claim 2 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

7. An improved hydraulic fluid composition comprising the composition of claim 3 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

8. An improved hydraulic fluid composition comprising the composition of claim 4 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

9. An improved fire resistant hydraulic base fluid composition having a specific gravity of less than 1.00, and a four-ball wear scar of less than 0.8 mm, the improvement consisting essentially of about one part by weight of a trialkyl phosphite ester having a pour point of less than −50° C., 2 to 4 parts by weight of a trialkoxyalkyl phosphate ester, wherein each alkoxyalkyl moiety contains about 6 to 10 carbon atoms, and an ester or a mixture of esters selected from the group consisting of a triaryl ester of phosphoric acid and C4–C8 alkyl alcohols, a triaryl phosphate ester wherein the aryl groups are partially C3 to C4 alkylated phenols, and each alkyl group of the trialkyl phosphate ester having from 8 to 12 carbon atoms, the ester or mixture of esters being present in an amount equal to about 0.4 to 4 parts by weight per part by weight of the phosphite ester.

10. The composition of claim 9 wherein the trialkoxyalkyl phosphate ester is tributoxyalkyl phosphate.

11. The composition of claim 10 wherein the trialkyl phosphite ester is triisooctyl phosphite.

12. An improved hydraulic fluid composition comprising the composition of claim 9 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

13. An improved hydraulic fluid composition comprising the composition of claim 10 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

14. An improved hydraulic fluid composition comprising the composition of claim 11 as a base fluid and also containing hydraulic fluid additives selected from the group consisting of alkylaromatic polymers, polymethacrylates, silicone polymers, hindered phenols, aromatic amines, amine succinates, alkaline earth succinates and zinc dithiophosphate.

* * * * *